United States Patent [19]

Sass

[11] 4,233,994

[45] Nov. 18, 1980

[54] WRAPPING PROCESS FOR CIGARS WITH NATURAL TOBACCO

[75] Inventor: Bernard J. Sass, Morlaix, France

[73] Assignee: Service d'Exploitation Industrielle des Tabacs, France

[21] Appl. No.: 874,889

[22] Filed: Feb. 3, 1978

[30] Foreign Application Priority Data

Feb. 9, 1977 [FR] France ..... 77 03559

[51] Int. Cl.[3] ..... A24C 1/26; A24C 1/28; A24C 1/30

[52] U.S. Cl. ..... 131/58; 131/62; 131/67; 131/8 R

[58] Field of Search ..... 131/14, 15 R, 16, 20 R, 131/21 R, 21 A, 23 R, 26, 27 R, 27 A, 28, 32, 58, 62, 64 R, 64 A, 60, 66 R, 67, 66 A, 77, 78, 94, 38, 43, 45, 39, 42, 36, 75, 52, 47, 48, 49, 50, 54, 85, 86, 80; 93/16 TP, 16 FT; 270/69

[56] References Cited

U.S. PATENT DOCUMENTS 2,868,209 1/1959 Marcotte ..... 131/85

FOREIGN PATENT DOCUMENTS 117745 3/1900 Fed. Rep. of Germany ..... 131/8 R
156084 12/1903 Fed. Rep. of Germany ..... 131/58

*Primary Examiner*—V. Millin
*Attorney, Agent, or Firm*—Jacobs & Jacobs

[57] ABSTRACT

The object of the invention is a wrapping process for cigars with natural tobacco through stamping of a wrapping surface with a pre-manufactured tobacco core and total wrapping of said tobacco core by said surface, a process in which before the stamping operation, the wrapping surface is maintained on its two areas in the vicinity of its longitudinal edges so that they are stretched during the stamping operation.

8 Claims, 8 Drawing Figures

WRAPPING PROCESS FOR CIGARS WITH NATURAL TOBACCO

The present invention relates to a new process for wrapping cigars with natural tobacco. First of all, it should be precised that the word "cigar" is used here in a very general acceptance covering all smokable products with an outside wrapping in natural tobacco.

According to a very schematic classification, there exists at present two wrapping processes which may be related to two types of cigars, those which are curved or conical and those which are cylindrical. The curved cigars, generally considered as higher class cigars, are wrapped according to a helical shape. Their wrapping is cut according to a particular shape which uses large quantities of raw material; on the other hand, the cutting and the wrapping of the envelope call for much precision. On the other hand the cylindrical cigars can be wrapped in the same manner as cigarettes are hand-rolled. The cutting of the wrapping and the wrapping operation itself have the advantage of being simple and rapid. But the end product may display some inappropriate and unaesthetic folds. And above all, for somewhat tapering the end of the cigar, it is known to compress it: which causes the formation of a multiplicity of folds and creases of the wrapping strip.

An other process which is very old, equally valid for cylindrical cigars and similar to the hereabove described process, consisted in stamping a wrapping surface with a tobacco core and folding over the longitudinal edges around the core. German Pat. Nos. 16 586 and 156 084 may be cited in particular. Obviously, said process offers the same disadvantages as those already cited. The aforementioned Pat. No. 156 084 obviates actually such disadvantages by way of a partial remedy wherein the wrapping surface of the curved cigars is provided with notches; the same applies to German Pat. No. 47 304 wherein the longitudinal edges of the wrapping strip are cut out in the shape of the teeth of a saw. But the result is then a cigar wrapping with folds and extra-thicknesses which are prejudicial to its appearance and to the regularity of its taste.

The present invention proposes to palliate the hereabove described disadvantages and advocates the use of one single and same process for all cigars, be they curved or cylindrical.

Said process is substantially characterized in that a wrapping surface is maintained on both its opposite longitudinal edges before stamping it by a previously prepared tobacco core, then to wrap completely the latter.

The process consists therefore in making use of the qualities of natural tobacco and substantially of its resiliency and its flexibility in order to perfectly adapt the wrapping strip to the shape of the cigar core, even if the latter is conical or curved: the wrapping surface will then only be more or less stretched in relation to the various diameters along the same cigar. Of course, one may benefit from such flexibility and resiliency of the tobacco only if, during the stamping operation, the wrapping surface is maintained on either side of the core, parallelly to its longitudinal axis.

One may stamp with the tobacco core the area which is substantially central of the concerned wrapping surface. This provides an extension as regular as possible of the various areas of the surface of the tobacco used for the wrapping.

But it is also possible to stamp with the tobacco core a lateral area of this wrapping surface. This modality makes the wrapping of the tobacco core easier, particularly when the wrapping surface is cut off from a continuous strip of natural tobacco only after stamping.

In this case in fact, the unrolled wrapping surface of the tobacco strip will have to be maintained only at its free end; the opposite end which remains attached to the continuous strip roll will be thereby maintained, and then by the tobacco core after stamping and cutting of the wrapping surface.

The process according to the invention therefore makes use of the natural resiliency and flexibility of the tobacco. Such qualities may still be improved by previously moistening the tobacco. But this of course is only valid within certain limits.

The process according to the invention provides therefore various solutions for the wrapping of cigars which are very curved. Such solutions associate and cumulate the respective advantages of the natural flexibility of tobacco and the more or less altered and adapted shape of the wrapping surface; it will be thereby possible to use either a somewhat modified but always single wrapping strip, or two half wrapping strips. The choice between one or the other solution will depend on the degree of flexibility of the raw material which is available.

The first solution consisting in using a single wrapping strip is applied in various modalities according to whether the shape is modified before or after wrapping around the tobacco core. It will be preferred to use one or the other modality as a function in particular of the aromatic and gustative qualities of the tobacco used which make the extra thicknesses more or less advantageous.

A first modality consists in making notches in the wrapping strip for providing a wrapping perfectly adapted to the shape of the tobacco core.

These notches may be made in various manners; the choice will be made as a function of the shape of the cigar and according to whether in particular its end is more or less tapered, longer or shorter.

It is possible therefore to make notches in the wrapping strip in at least one extreme area, or also at the level on at least one transition area between the substantially cylindrical shape of the cigar and one tapered end. These notches may be single slots or follow the shape of the teeth of a saw. According to the shape of the cigar, the process will be applied to a single end or to both ends of the wrapping strip. Such notches may be made before or after stamping.

A second modality consists, once the wrapping strip has been stamped by the tobacco core and has been completely wrapped as a cylinder, in that at least one portion of the end of the wrapping strip is folded over on itself so that its diameter corresponds perfectly to that of the corresponding end of the tobacco core, then in that the portion or portions of the wrapping strip which are not in contact with the core are cut out. A perfect complementarity of the shapes of the wrapping strip and of the tobacco core is thereby obtained, inasmuch as the wrapping end is shaped for providing a smooth transition for the difference in diameter of the wrapping and the tobacco core. In order to obtain a smooth surface, it will be sufficient to cut the wrapping folds flush with the cigar surface. In order to maintain the wrapping adherent to the tobacco core, it will be sufficient to previously size either the tobacco core or the inner surface of the wrapping. This modality offers the advantage of being very simple and of being adaptable to the diameter eventual variations of the cigar ends, from one cigar to the next. On the other hand, its avoids extra thicknesses and provides regularity in the gustative qualities of the product all along when it is smoked.

The cigar wrapped in this way with a single wrapping strip exhibits outside one single seam extending on all its length. While drying up of the glue in the area of said seam, there is a risk that a tension is created causing the cigar to curve.

For avoiding such a deflexion, the process according to the invention provides moistening of the wrapping along a longitudinal area diametrally opposite the seam of the end product, that is along a line parallel to, and located substantially at an equal distance from both lines of the wrapping which, through their junction, form the wrapping seam. More precisely, one moistens the inner face of the wrapping by means of a fluid creating, when drying up, a tension which is equivalent to that existing in the area of the seam of the end product.

This solution provides advantageously, while being simple, the neutralization of the tension effect in the area of the seam, both tensions balancing and compensating each other. Preferably, the same fluid will be used as the one which was used in the area of the seam: for instance glue.

The second solution which is advocated for the process according to the invention and relating to the wrapping of very curved cigars, consists in stamping a half wrapping strip with each half tobacco core defined by a cross-section of the core in a plane containing its longitudinal axis. The invention provides therefore a new cigar characterized in that it is wrapped with two half wrapping strips, each of which covers a half cigar when considered along a median longitudinal cross-section.

It should be precised that in this case, there is no problem of cigar deflection: the two junction areas of the two half wrapping strips are in opposite diametral relationship and the tension effects cancel each other.

In order to provide total wrapping of the tobacco core in the wrapping surface, it is sufficient that the adjacent longitudinal edges of the wrapping strip or of the two half wrapping strips are jointed. But for providing perfect tightness of the wrapping element, a partial overlapping of said longitudinal edges will be preferable.

This partial overlapping may be obtained in conventional manner, the inner surface of one edge covering the outer surface of the adjacent end.

A further modality consists, after stamping the wrapping surface with the tobacco core, in bringing together the corresponding longitudinal edges of the wrapping strip or of the two half wrapping strips; in overlapping them partially, their inner faces being opposite each other; in applying a pressure on each assembly formed by two edges so connected, such that the wrapping surface is seamed; and finally in partially cutting, if necessary, each outer seam which is so formed on the cigar.

This further modality seems particularly advantageous in the case of the wrapping of cigars with two half wrapping strips: the formation and closing of the two seams is made largely simpler. A simple knurling of the wrapping portions which are not in contact with the tobacco core should be sufficient. Said knurling may be made still more efficient by heating and moistening the concerned areas.

It should also be precised that said modality provides also the possibility of totally sealing the cigar wrapping: a cigar is thereby obtained the two edges of which are sealed and do not run the risk of being emptied, whatever the degree of dryness to which the inner tobacco is subjected while being stored.

In order to maintain the wrapping surface around the tobacco core, it is foreseen to size at least one of the parts in contact on one portion at least of said contact. Sizing will be made before or after stamping according to whether sizing will be made on the outer surface of the tobacco core or on the inner face of the wrapping strip or of at least one half wrapping strip, and also whether the sizing will be performed on the whole of said surfaces or only on part of them.

But, with the aim of using as little glue as possible and thereby practically not modifying the taste of the smoke, it is foreseen to size preferably at least one part of the inner face of at least one half wrapping strip: a line of glue will be laid parallel and adjacent the inner longitudinal edges of the half wrapping strip which will come overlapping the edges of the other half wrapping strip which is still then maintained wrapped around the tobacco core, for instance through a slight dying or due to the adherence of the wet tobacco, or again through movable folders.

The following description applies to only some non limitative embodiments of the process according to the invention, in conjunction with the accompanying drawings wherein.

Figure 1:
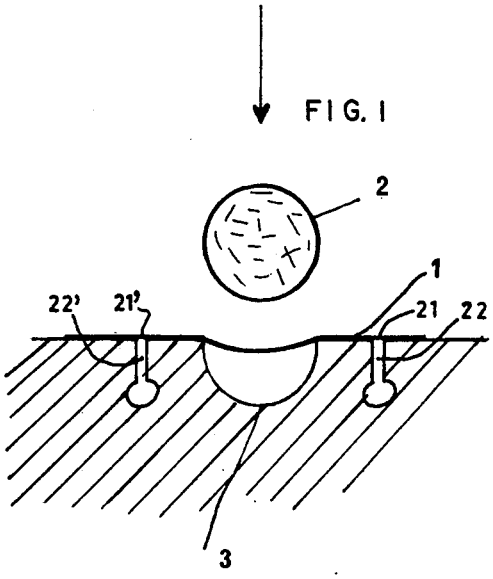
FIG. 1 is a schematic cross-sectional view of one mode of the process according to the invention.

In the example of FIG. 1, the wrapping strip 1 is maintained in the areas of its two longitudinal edges 21, 21' through a suction action. Said two edges rest to this effect above notches 22, 22' connected to a vacuum source, while the central part of the wrapping strip is positioned above a recess 3 the shape of which matches that of tobacco core 2 which has to be surrounded by the wrapping strip. When the tobacco core 2 is engaged into the recess 3, it alters the shape of wrapping strip 1, but the edges of the latter are maintained above notches 21, 21' and the strip is thereby stretched during the stamping operation.

Figure 2:
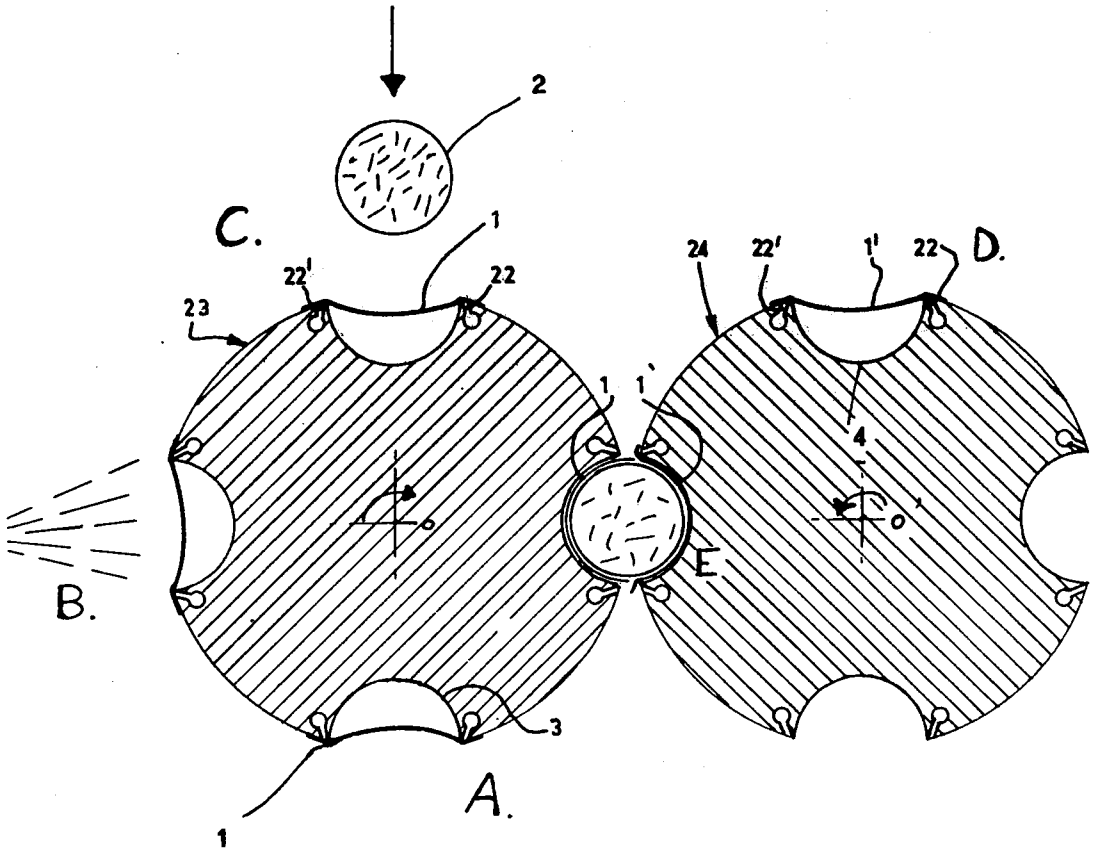
FIG. 2 is a schematic cross-section view of an embodiment of the device for practicing the process according to the invention.

In the embodiment of FIG. 2, there are provided two drums 23, 24 formed with recesses 3 and 4 respectively and rotating in reverse directions about two parallel axes O and O'.

On the edges of each recess are provided notches 22, 22' connected to a vacuum source.

At station A, a half wrapping strip 1 has been positioned over the recess 3 of drum 23 and its edges are maintained through a suction applied through slots 22, 22' connected with a vacuum source.

At station B, the surface of the half wrapping strip may be sized, or wetted, for improving the resiliency of the tobacco, as well as for favouring the further adherence to the tobacco core.

At station C, the half wrapping strip is stamped by tobacco core 2. At station E, the same core 2 stamps a second half wrapping strip 14 previously positioned and maintained also through suction over the complementary recess 4 of the second drum 24. This second half wrapping strip 1' may have been previously sized, for instance at station D, along a line parallel and adjacent its longitudinal edges. The tobacco core may be then slightly rolled over itself in one direction and then in the other for applying the sized edges of the second half wrapping strip 1' onto the outside edges of the first half wrapping strip 1. Preferably, the edges of the half wrapping strips will be folded over tobacco core 2 by means of movable folders.

Figure 3A:
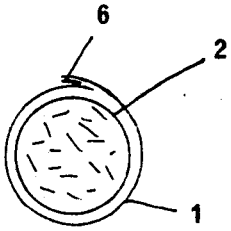
FIG. 3 shows a cross-sectional view of some cigars obtained according to the process of the invention.
Figure 3B:
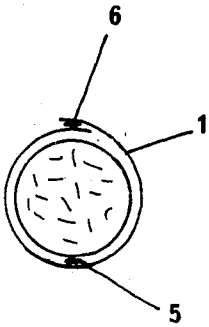
Figure 3C:
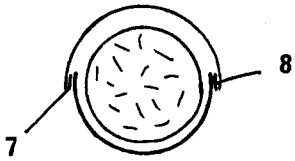

In FIG. 3 are shown in cross-section three cigars which have been wrapped according to a particular modality of the process of the invention.

According to A and B, the wrapping surface 1 is a single wrapping strip; but in modality B, a line of glue 5 has been laid on the inner surface of the wrapping strip for correcting the deflection effect caused by the single seam 6. In modality C, the two half wrapping strips are partially overlapping and only the two diametrally opposed areas 7 and 8 are sized.

Figure 4:
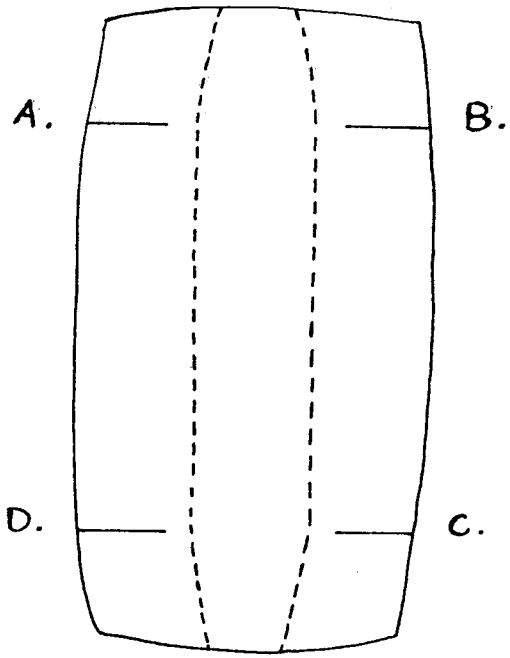
FIGS. 4 and 5 show modifications of a whole envelope for wrapping very curved cigars.
Figure 5:
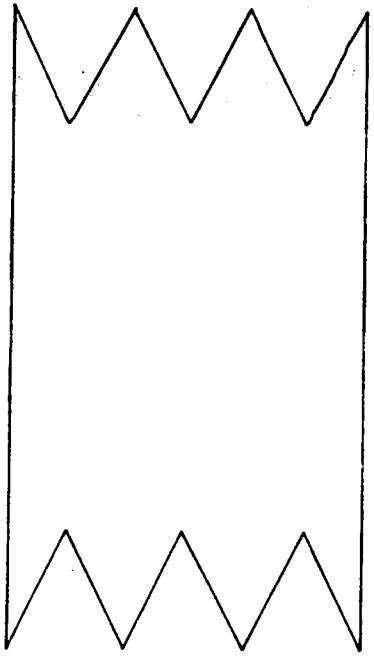

FIGS. 4 and 5 show the alterations which may be applied to the shape of complete wrapping strips for wrapping very curved cigars.

In FIG. 4, four notches (A, B, C, D) are formed in the wrapping strip as from the longitudinal side edges of the wrapping strip and substantially perpendicularly to the latter. Said notches are situated, in pairs, in the two transition areas between the substantially cylindrical portion and the tapered ends of the tobacco core. Said notches may be formed before or after stamping of the wrapping strip by the tobacco core.

In FIG. 5, each wrapping end is cut out according to a profile in the shape of the teeth of a saw. Once the wrapping strip has been stamped by the tobacco core, the portion of the wrapping strip which has not been notched is wrapped around the tobacco core, and each profile with the shape of the teeth of a saw is folded over the corresponding portion of the tobacco core, the teeth being positioned so as to overlap each other.

Figure 6A:
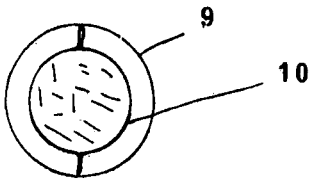
FIGS. 6A and 6B shows a cross sectional view of two curved cigars according to the present invention.
Figure 6B:
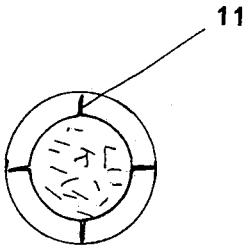

FIGS. 6A and 6B show the cross-section of two curved cigars with the end of their wrapping strip shaped after it has been wrapped around the tobacco core. The larger and the smaller diameter of the cigar have been represented at 9 and 10. The folds 11 of the wrapping strip about the end of the cigar correspond substantially to the difference between said two diameters. It is thereby possible to provide the wrapping strip with one or several folds according to the degree of curvature of the cigar. It may be advantageous to exert on the wrapping strip, in the area of said folds, tensions which are in opposite directions and tangent the circumference of the tobacco core, for obtaining a perfect fit of the wrapping around the tobacco core. It is then only sufficient to cut, even to erase, these folds from the wrapping, for giving the cigar its traditional aspect.

Figure 7:
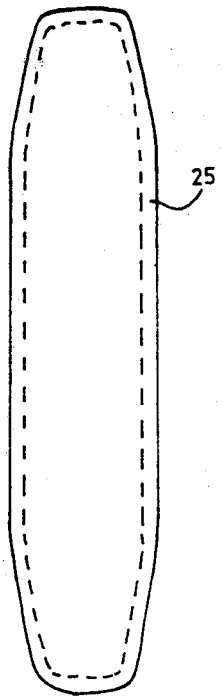
FIG. 7 shows a wrapping surface for enclosing a tobacco core.

FIG. 7 shows an original way of closing the wrapping surface. The cigar is wrapped with two half wrapping strips which totally enclose the tobacco core: there is only one continuous seam 25 running around the cigar. The edges of the half wrapping strips are superimposed, the outer face against the inner face; the seam is therefore outside, namely not in contact with the tobacco core. In order to provide closing of the seam, the two edges are pressed against each other: said pressure may be applied for instance by knurling. Glue may also be used. Finally, if necessary, one may cut somewhat the edges forming the seam so that the latter does not have too much importance in proportion to the tobacco core.

What I claim is:

1. In the process of wrapping a premanufactured tobacco core with natural tobacco wrapper in which the circumferential surface of the core is totally surrounded with one or more sections of wrapper joined at their longitudinal edges in a like number of seams so as to form a continuous wrapper about said core, the improvement which comprises maintaining each of said wrapper sections in stretched condition between its longitudinal edges while said core is being surrounded and said seams are being formed.

2. The process according to claim 1 wherein each of said wrapper sections is moistened prior to said core being surrounded.

3. The process according to claim 2 wherein said sections are moistened with a liquid operable upon drying to effect a substantially uniform circumferential tension about said core.

4. The process according to claim 1 wherein said seams are formed after a longitudinal edge of each section is overlapped with its opposite longitudinal edge, or with the edge of an adjacent section, until the composite inner surface complements the circumferential surface of the core, and said overlapped portion not in contact with the core is removed after said seam is formed.

5. The process according to claim 1 wherein said seams are formed after an inside, edge-adjoining surface portion of a section is brought into face to face contact with a portion of the same surface adjoining the opposite edge or with an inside edge adjoining surface portion of an adjacent section until the composite inner surface of the wrapper complements the circumferential surface of the core, said seam being formed from said portions in face to face contact, and excess of said seam is then removed.

6. The process according to claim 1 wherein said core is surrounded by a single wrapper section.

7. The process according to claim 1 wherein said core is surrounded by two wrapper sections positioned about said core and joined by two seams lying substantially in a plane common to the axis of said core.

8. The process according to claim 1 wherein at least a portion of the inner surface of said wrapper sections is sized.

* * * * *